US005498345A

United States Patent [19]

Jöllenbeck et al.

[11] Patent Number: 5,498,345

[45] Date of Patent: Mar. 12, 1996

[54] AQUEOUS DISPERSION OF SPARINGLY SOLUBLE UV ABSORBERS

[75] Inventors: Martin Jöllenbeck, Freiburg, Germany; Alfred J. Neukom, Augst, Switzerland

[73] Assignee: Ciba-Geigy Corporation, Tarrytown, N.Y.

[21] Appl. No.: 200,892

[22] Filed: Feb. 22, 1994

Related U.S. Application Data

[63] Continuation of Ser. No. 805,431, Dec. 11, 1991, abandoned.

[30] Foreign Application Priority Data

Dec. 13, 1990 [CH] Switzerland ..... 3945/90

[51] Int. Cl.[6] ..... F21V 9/04; D06P 5/02

[52] U.S. Cl. ..... 252/589; 8/442; 8/573; 8/607

[58] Field of Search ..... 252/582, 589; 8/442, 573, 607

[56] References Cited

U.S. PATENT DOCUMENTS

| | | | |
|---|---|---|---|
| 3,004,896 | 10/1961 | Heller | 252/589 |
| 3,931,072 | 1/1976 | Coyle | 260/17.5 |
| 4,202,838 | 5/1980 | Lauton | 260/505 |
| 4,386,037 | 5/1983 | Baumann | 260/512 |
| 4,557,730 | 12/1985 | Bennett | 8/442 |
| 4,895,981 | 1/1990 | Reinert et al. | 252/589 |
| 5,009,669 | 4/1991 | Jöllenbeck | 8/573 |

FOREIGN PATENT DOCUMENTS

| | | |
|---|---|---|
| 0345219 | 12/1989 | European Pat. Off. . |
| 1195307 | 11/1959 | France . |
| 2546544 | 11/1984 | France . |

*Primary Examiner*—Philip Tucker
*Attorney, Agent, or Firm*—Kevin T. Mansfield

[57] ABSTRACT

Aqueous stable dispersions of a mixture of sparingly soluble UV absorbers, which comprises (a) 5 to 50% by weight of a mixture of a benzotriazole of formula

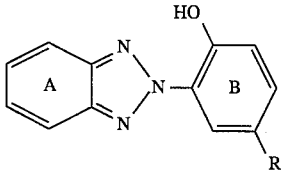

(1)

and a 2-hydroxybenzophenone of formula

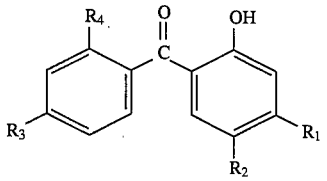

(2)

wherein R is halogen, $C_1$-$C_{12}$alkyl, lower alkoxy, lower alkoxycarbonyl, cycloalkyl, aryl, $C_1$-$C_{12}$alkylaryl or aralkyl, and the rings A and B, each independently of the other, may be further substituted by halogen, hydroxy, lower alkyl, lower alkoxy or lower alkoxycarbonyl,
$R_1$ is hydrogen, hydroxy, $C_1$-$C_{14}$alkoxy or phenoxy,
$R_2$ is hydrogen, halogen or lower alkyl,
$R_3$ is hydrogen, hydroxy or lower alkoxy, and
$R_4$ is hydrogen or hydroxy, (b) 2 to 18% by weight of an anionic compound, and (c) 0 to 10% by weight of a nonionic compound.

These dispersions of a mixture of UV absorbers are excellent compositions for enhancing the lightfastness of dyeings on synthetic fibers and, in particular, on polyester fibers or acid-modified fibers.

25 Claims, No Drawings

AQUEOUS DISPERSION OF SPARINGLY SOLUBLE UV ABSORBERS

This application is a continuation of application Ser. No. 07/805,431, filed Dec. 11, 1991, abandoned.

The present invention relates to an aqueous dispersion of a mixture of sparingly soluble UV absorbers and to the use thereof for dyeing synthetic fibres, especially polyester fibres or acid-modified polyester fibres.

The novel aqueous dispersion of a mixture of sparingly soluble UV absorbers comprises (a) 5 to 50% by weight of a mixture of a benzotriazole of formula

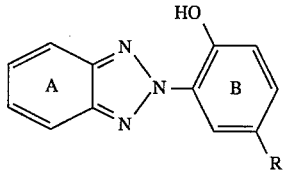

(1)

and a 2-hydroxybenzophenone of formula

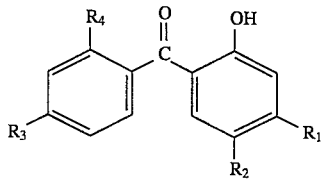

(2)

wherein R is halogen, $C_1$-$C_{12}$alkyl, lower alkoxy, lower alkoxycarbonyl, cycloalkyl, aryl, $C_1$-$C_{12}$alkylaryl or aralkyl, and the rings A and B, each independently of the other, may be further substituted by halogen, hydroxy, lower alkyl, lower alkoxy or lower alkoxycarbonyl, $R_1$ is hydrogen, hydroxy, $C_1$-$C_{14}$alkoxy or phenoxy, $R_2$ is hydrogen, halogen or lower alkyl, $R_3$ is hydrogen, hydroxy or lower alkoxy, and $R_4$ is hydrogen or hydroxy, (b) 2 to 18% by weight of an anionic compound, and (c) 0 to 10% by weight of a nonionic compound.

The novel aqueous dispersion conveniently comprises 10 to 45% by weight of component (a), 3 to 15% by weight of component (b), and 0 to 8% by weight of component (c).

The compounds of component (a) preferably have a particle size smaller than 5 μm.

Component (a), as well as components (b) and (c), may be in the form of individual compounds or in the form of a mixture.

Lower alkyl and lower alkoxy in the definition of the radicals of the compounds of formulae (1) and (2) denote those groups or moieties which contain 1 to 5, preferably 1 to 3, carbon atoms. Illustrative examples of such groups are methyl, ethyl, n-popyl, isopropyl, n-butyl, sec-butyl, tert-butyl, amyl, isoamyl or tert-amyl, and methoxy, ethoxy, isopropoxy, isobutoxy or tert-butoxy.

$C_1$-$C_{12}$Alkyl is typically ethyl, amyl, tert-octyl, n-dodecyl and, preferably, methyl, sec-butyl or tert-butyl.

Halogen is typically fluoro, bromo or, preferably, chloro.

An alkyl group substituent in formulae (1) and (2) may be straight-chain or branched. Exemplary of such alkyl radicals are methyl, ethyl, n-propyl, isopropyl, n-butyl, isobutyl, sec-butyl, tert-butyl, amyl, isoamyl, tert-amyl, n-hexyl, 2-ethylhexyl, n-heptyl, n-octyl, isooctyl, n-nonyl, isononyl or n-dodecyl.

R defined as cycloalkyl is cyclopentyl, cycloheptyl or, preferably, cyclohexyl. The cycloalkyl radicals may contain one or more $C_1$-$C_4$alkyl radicals, preferably methyl groups and contain a total of 5 to 10 carbon atoms.

R defined in formula (1) as "aryl" is preferably phenyl. The aryl and in particular the phenyl radical can be substituted by one or two members selected from the group consisting of halogen, lower alkyl, such as methyl, or lower alkoxy, such as methoxy.

R as alkylaryl is suitably alkylphenyl, and the alkyl moiety is preferably in para-position. The alkyl moieties of alkylphenyl may be methyl, ethyl, isopropyl, butyl, hexyl, n-octyl, tert-octyl, n-nonyl, isononyl, decyl or dodecyl.

R defined as aralkyl conveniently contains a total of 7 to 9 carbon atoms and will normally be benzyl, α-methylbenzyl, α-α-dimethylbenzyl, β-phenethyl, α-tolylethyl or phenisopropenyl.

The ring A is preferably substituted in 5-position by halogen, lower alkyl or lower alkoxy. The ring A may conveniently carry further substituents, such as halogen or methyl, in 6-position.

The benzene ring B is also preferably substituted for example by halogen or lower alkyl in vicinal position to the hydroxyl group.

In formula (2), $C_1$-$C_{14}$alkoxy may be methoxy, ethoxy, propoxy, n-butoxy, octyloxy, dodecyloxy or tetradecyloxy.

Useful benzotriazoles of component (a) are those of formula

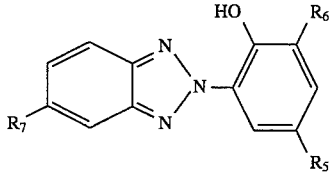

(3)

wherein $R_5$ is halogen, lower alkyl or lower alkoxy, and $R_6$ and $R_7$ are each independently of the other hydrogen, halogen, lower alkyl or lower alkoxy.

Preferred benzotriazoles are those in which $R_5$ is lower alkyl such as methyl or tert-butyl, $R_6$ is hydrogen or lower alkyl, and $R_7$ is hydrogen, chloro or methyl.

Important compounds are 2-(2'-hydroxy-5'-methylphenyl)benzotriazole, 2-(2'-hydroxy-3',5' -dimethylphenyl)benzotriazole, 2-(2'-hydroxy-5'-tert-butylphenyl)benzotriazole, 2-(2'-hydroxy-3'-tert.butyl-5'methylphenyl)-5-chlorobenzotriazole, 2-(2'-hydroxy -3',5'-di-tert-butylphenyl)-5-chlorobenzotriazole, 2-(2'-hydroxy-3',5'-di-tert-amylphenyl) benzotriazole or 2-(2'-hydroxy-3',5'-di-tert-butylphenyl) benzotriazole.

Interesting 2-hydroxybenzotriazoles of formula (2) are those in which $R_1$ is hydroxy or $C_1$-$C_{14}$alkoxy.

Exemplary of 2-hydroxybenzophenones of formula (2) are the 4-hydroxy, 4-methoxy, 4-octyloxy, 4-decyloxy, 4-dodecyloxy, 4-benzyloxy and 5-chloro derivatives.

Most of the known benzotriazole UV absorbers of formulae (1) and (3) are disclosed in French patent 1 195 307.

The dispersion of this invention contains the compounds of formulae (1) and (2) in a ratio (1):(2) of 30:1 to 1:30, preferably 10:1 to 1:10. Ratios of 1:5 to 5:1 are especially preferred, wherein the weight ratio of the compound of formula (1) is smaller than 20%.

Suitable components (b) are anionic dispersants like the compounds selected from the group consisting of (ba) acid esters, or their salts, of alkylene oxide polyadducts of formula

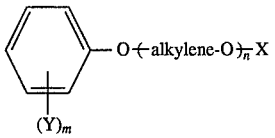

(4)

wherein X is the acid radical of an inorganic oxygen-containing acid such as sulfuric acid or, preferably, phosphoric acid, or is also the radical of an organic acid, and Y is $C_1$-$C_{12}$alkyl, aryl or aralkyl, "alkylene" is the ethylene or propylene radical, and m is 1 to 4 and n is 4 to 50, (bb) polystyrene sulfonates, (bc) fatty acid taurides, (bd) alkylated diphenyl oxide mono- or disulfonates, (be) sulfonates of polycarboxylates, (bf) polyadducts of 1 to 60 mol, preferably 2 to 30 mol, of ethylene oxide and/or propylene oxide with fatty amines, fatty amides, fatty acids or fatty alcohols, each of 8 to 22 carbon atoms or with trihydric to hexahydric alkanols of 3 to 6 carbon atoms, which polyadducts have been convened into an acid ester with an organic dicarboxylic acid or an organic polybasic acid, (bg) ligninsulfonates, and (bh) formaldehyde condensates.

The acid radical X in formula (4) is conveniently derived from low molecular dicarboxylic acids, typically maleic acid, succinic acid or sulfosuccinic acid, and is linked through an ester bridge to the alkylene oxide part of the molecule. Preferably, however, X is derived from an inorganic polybasic acid such as sulfuric acid or, more particularly, orthophosphoric acid.

An alkyl group Y in formula (4) can be straight-chain or branched and is typically methyl, ethyl, n-propyl, isopropyl, n-butyl, isobutyl, sec-butyl, tert-butyl, amyl, isoamyl, tert-amyl, n-hexyl, 2-ethylhexyl, n-heptyl, n-octyl, isooctyl, n-nonyl, isononyl or n-dodecyl.

Y as aralkyl preferably contains altogether 7 to 9 carbon atoms and is typically benzyl, α-methylbenzyl, α,α-dimethylbenzyl, β-phenethyl, α-tolylethyl or phenisopropyl.

Y in formula (4) is preferably $C_4$-$C_{12}$alkyl, benzyl, preferably $C_4$-$C_{10}$alkyl or, most preferably, α-methylbenzyl.

The substituent Y may also have different cited meanings.

n is preferably 6 to 30, and m is preferably 1 to 3.

(Alkylene-O-)$_n$ chains are preferably of the ethylene glycol, propylene ethylene glycol or ethylene propylene glycol type; the first type is preferred.

The acid esters of formula (4) suitable for use as component (ba) are prepared by addition of alkylene oxide (ethylene oxide or propylene oxide) to a substituted phenol as defined herein and converting the polyadduct with a polybasic oxyacid or a functional derivative thereof, typically an acid anhydride, acid halide, acid ester or acid amide, into the acid ester and, if desired, converting said acid ester into an aforementioned salt. Illustrative examples of these functional derivatives are phosphorus pentoxide, phosphoroxy trichloride, chlorosulfonic acid or sulfamic acid. The addition of alkylene oxide as well as the esterification can be carried out by known methods.

Illustrative examples of the anionic compounds mentioned in (bc) to (bh) are:

as component (bc), suitably compounds of formula (5) R-CO-NH-$CH_2$-$CH_2$-$SO_3H$, wherein R is $C_{11}$-$C_{17}$alkyl (cf. for example U.S. Pat. No. 4,219,480)

as component (bd), suitably compounds of formula (6)

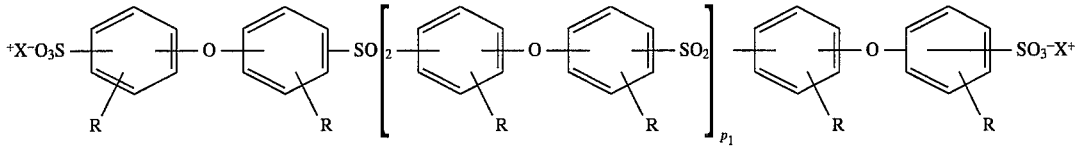

wherein R is $C_{10}$-$C_{18}$alkyl,

X is hydrogen or alkali metal and $P_1$ is 0 to 6.

as component (be), suitably dihexylsulfosuccinates, bis(2-ethylhexyl)sulfosuccinates, dioctylsulfosuccinates, sulfosuccinamides or compounds of formula

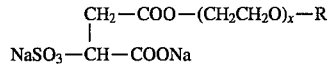

(7)

wherein R is $C_8$-$C_{18}$alkyl or alkylphenol containing 4 to 12 carbon atoms in the alkyl moiety and x is 1 to 10, preferably 2 to 4;

as component (bf), polyadducts of 2 to 30 mol of ethylene oxide with fatty amines, fatty amides, fatty acids or fatty alcohols or trihydric to hexahydric alkanols, which polyadducts have been converted into an acid ester of maleic acid, malonic acid, sulfosuccinic acid and, preferably, o-phosphoric acid or, most preferably, with sulfuric acid;

as component (bh), suitably condensates of ligninsulfonates and/or phenol and formaldehyde, condensates of formaldehyde and aromatic sulfonic acids such as condensates of ditolyl ether sulfonates and formaldehyde, condensates of naphthalenesulfonic acid and/or naphthol- or naphthylaminesulfonic acids with formaldehyde, condensates of phenolsulfonic acids and/or sulfonated dihydroxydiphenylsulfone and phenols or cresols with formaldehyde and/or urea, as well as condensates of diphenyl oxide-disulfonic acid derivatives with formaldehyde.

It is preferred to use component (bh) as component (b) in the novel aqueous dispersion. Particularly preferred compounds as component (bh) are the condensates of ditolyl ether sulfonates and formaldehyde described in U.S. Pat. No. 4,386,037, the condensates of phenol and formaldehyde with ligninsulfonates described in U.S. Pat. No. 3,931,072, condensates of 2-naphthol-6-sulfonic acid, cresol, sodium bisulfite and formaldehyde [cf. HAT-Report 1013 (1946)], and the condensates of diphenyl derivatives and formaldehyde described in U.S. Pat. No. 4,202,838.

The acid radical of the anionic compounds is normally in salt form, i.e. as alkali metal salt, ammonium salt or amine salt. Typical examples of such salts are lithium, sodium, potassium, ammonium, trimethylamine, ethanolamine, diethanolamine or triethanolamine salts.

Suitable for use as component (c) are the compounds which are selected from the group of (ca) alkylene oxide polyadducts of formula

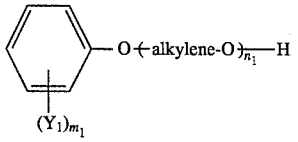

(8)

wherein $Y_1$ is $C_1$-$C_{12}$alkyl, aryl or aralkyl,

"alkylene" denotes the ethylene radical or propylene radical and $m_1$ is 1 to 4 and $n_1$ is 4 to 50, (cb) polyadducts of alkylene oxide with (cba) saturated or unsaturated monohydric to hexahydric aliphatic alcohols, (cbb) fatty acids, (cbc) fatty amines, (cbd) fatty amides, (cbe) diamines, (cbf) sorbitan esters, (cc) alkylene oxide condensates (block polymers), (cd) polymers of vinyl pyrrolidone, vinyl acetate or vinyl alcohol, and (ce) copolymers or terpolymers of vinyl pyrrolidone with vinyl acetate and/or vinyl alcohol.

Very suitable components (ca) are polyadducts of 4 to 40 mol of ethylene oxide with 1 mol of a phenol which contains at least one $C_4$-$C_{12}$alkyl group, one phenyl group, one tolyl group, one α-tolylethyl group, one benzyl group, one α-methylbenzyl group or one α,α-dimethylbenzyl group, conveniently butylphenol, tributylphenol, octylphenol, nonylphenol, dinonylphenol, o-phenylphenol, benzylphenol, dibenzylphenol, α-tolylethylphenol, dibenzyl(nonyl)phenol, α-methylbenzylphenol, bis(α-methylbenzyl)phenol or tris(α-methylbenzyl)phenol, which adducts may be used singly or in admixture.

Especially suitable is a polyadduct of 6 to 30 mol of ethylene oxide with 1 mol of 4-nonylphenol, with 1 mol of dinonylphenol or with 1 mol of a compound which is obtained by the addition of 1 to 3 mol of a styrene compound to 1 mol of phenol.

Preferred ethylene oxide polyadducts are those of formula

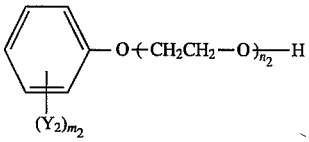

(9)

wherein $Y_2$ is $C_4$-$C_{12}$alkyl, phenyl, tolyl, tolyl-$C_1$-$C_3$alkyl or phenyl-$C_1$-$C_3$alkyl, such as α-methyl- or α,α-dimethylbenzyl, and $m_2$ is 1 to 3 and $n_2$ is 4 to 40.

The nonionic component (cb) is conveniently a polyadduct of 1 to 100 mol of alkylene oxide, such as ethylene oxide and/or propylene oxide, with 1 mol of an aliphatic monoalcohol containing at least 4 carbon atoms, of a trihydric to hexahydric aliphatic alcohol or of a phenol which may be substituted by alkyl, phenyl, α-tolylethyl, benzyl, α-methylbenzyl or α,α-dimethylbenzyl (cba);

a polyadduct of 1 to 100 mol, preferably 2 to 80 mol, of ethylene oxide with higher unsaturated or saturated monoalcohols (cba), fatty acids (cbb), fatty amines (cbc) or fatty amides (cbd) of 8 to 22 carbon atoms, individual ethylene oxide units of which polyadduct may be replaced by substituted epoxides such as styrene oxide and/or propylene oxide;

a polyadduct of alkylene oxide, preferably of ethylene oxide and propylene oxide, with ethylenediamine (cbe);

an ethoxylated sorbitan ester containing long-chain ester groups, such as polyoxyethylene sorbitan monolaurate containing 4 to 20 ethylene oxide units, or polyoxyethylene sorbitan trioleate containing 4 to 20 ethylene oxide units (cbf).

Preferred components (cc) are ethylene oxide/propylene oxide adducts (EO-PO block polymers) and propylene oxide/polyethylene oxide adducts (reversed EO-PO block polymers).

Particularly preferred EO-PO block polymers are those having molecular weights, based on polypropylene oxide, of 1700 to 4000, and containing 30–80%, preferably 60–80%, of ethylene oxide in the entire molecule.

In addition to components (a), (b) and (c), the dispersion of this invention conveniently also contains as component (d) a stabiliser or thickener.

Component (d) is most suitably a carboxyl group containing polymer. This polymer is added in the form of a 0.5 to 10%, preferably 0.5 to 5%, aqueous solution or dispersion, based on said solution or dispersion.

These polymers are preferably polymerised, ethylenically unsaturated mono- or dicarboxylic acids of 3 to 5 carbon atoms, such as polyacrylic acid or polymers of methacrylic acid, crotonic acid, itaconic acid, teraconic acid, maleic acid or the anhydride thereof, fumaric acid, citraconic acid or mesaconic acid, copolymers of olefins such as ethylene or propylene, diketenes, acrylates, methacrylates or acrylamides and the aforementioned monomers including acrylic acid or copolymers of acrylic acid with methacrylic acid, methacrylonitrile or vinyl monomers, such as vinylphosphonic acid, copolymers of maleic acid and styrene, maleic acid and a vinyl ether or maleic acid and a vinyl ester, such as vinyl acetate or copolymers of vinyl pyrrolidone with vinyl acetate or vinylpropionic acid.

The carboxyl group containing polymers forming the thickeners can have a molecular weight of 0.5 to 6 million.

Solutions of polyacrylic acid or also copolymers of acrylic acid and acrylamide have been found to be especially useful components (d). The molecular weight of these copolymers varies from 0.5 to 6 million. The molar ratio of acrylic acid:acrylamide in these copolymers is conveniently 1:0.8 to 1:1.2. A partially hydrolysed polymaleic anhydride can also be used as component (d). It is partly in the form of a water-soluble salt and has a molecular weight in the range of preferably 300 to 5000.

Further useful thickeners as component (d) are polysaccharides such as carboxymethyl cellulose, methyl cellulose, methyl- or ethylhydroxyethyl cellulose, carob seed gum ether or starch ethers as well as alginates, polyethylene glycols, polyvinylpyrrolidones, polyvinyl alcohols or also finely particulate silicic acid preferably having a specific surface area of 50 to 380 $m^2/g$, and sheet silicates such as bentonites, bentones, smectites and montmorillonites. Also very suitable are anionic heteropolysaccharides which are formed from the monosaccharides, glucose and mannose and glucuronic acid.

The amount of this additional component (d) is normally from 0.05 to 8 percent by weight, preferably from 0.1 to 4 percent by weight, based on the entire aqueous dispersion.

Besides components (a), (b) and optionally (c) or (d), the aqueous dispersion may additionally contain antifoams, preservatives or antifreeze agents.

The antifoams present in the dispersions of the invention may be silicone oils as well as antifoams based on tributylphosphate, 2-ethylhexanol or tetramethyl-5-decinediols (=Surfynol).

Preferred antifoams are alkylenediamides, typical representatives being methylenebis(stearamide), ethylenebis(stearamide) and ethylenebis(behenamide).

The alkylenediamide is preferably present in the dispersion in an amount of 0.2 to 0.5 percent by weight.

Suitable preservatives for use in the novel dispersions are a wide range of commercially available products, such as aqueous solutions of formaldehyde, 6-acetoxy-2,4-dimethyldioxane, 1,2-benzisothiazolin-3-one and, preferably, 2-chloroacetamide.

Antifreeze agents which can be added to the dispersions of the invention to preserve flowability at low temperatures and to prevent water from freezing are glycols or polyols, typically ethylene glycol, propylene glycol or glycerol, and polyethylene glycols, such as di-, tri- or tetraethylene glycol. A preferred antifreeze agent is propylene glycol.

Preferred aqueous dispersions of this invention comprise a mixture of a UV absorbing benzotriazole and a 2-hydroxybenzophenone of formulae (1) and (2) as component (a), and a condensate of formaldehyde and an aromatic sulfonic acid as component (b).

Particularly interesting dispersions of this invention axe those wherein component (a) is a mixture of a UV absorbing benzotriazole of formula

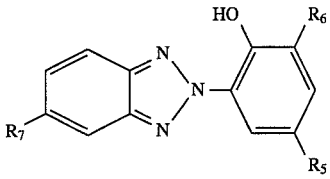

(3)

wherein $R_5$ is lower alkyl, $R_6$ is hydrogen or lower alkyl, and $R_7$ is hydrogen, chloro or methyl, and a 2-hydroxybenzophenone of formula (2), wherein $R_1$ is $C_1$-$C_{14}$alkoxy, and component (b) is a condensate of formaldehyde with an aromatic sulfonic acid.

Further interesting dispersions of this invention are those wherein component (a) is a mixture of a UV absorbing benzotriazole of formula (3) and a 2-hydroxybenzophenone of formula (2) and component (b) is a phosphate ester, or the salt thereof, of a polyadduct of 6 to 30 mol of ethylene oxide with 1 mol of 4-nonylphenol or dinonylphenol, or with 1 mol of a compound which is prepared by addition of 1 to 3 mol of styrene, α-methylstyrene or vinyl toluene to 1 mol of phenol, cresol or xylenol.

The aqueous dispersions of the invention advantageously comprise, in each case based on the entire dispersion, 5–50 percent by weight, preferably 10–45 percent by weight, of component (a), 20–18 percent by weight, preferably 3–15 percent by weight, of component (b), 0–10 percent by weight, preferably 0–8 percent by weight, of component (c), 0–5 percent by weight, preferably 0.1 to 4 percent by weight, of component (d), 0–8 percent by weight of further anionic components other than component (b), 0–8 percent by weight of further nonionic components other than component (c), 0–2 percent by weight, preferably 0.1 to 5 percent by weight, of antifoam, 0–1 percent by weight, preferably 0.1 to 0.5 percent by weight, of preservative, and 0–20 percent by weight of antifreeze agent.

The dispersion of this invention is conveniently prepared by making the benzotriazole of formula (1) together with the 2-hydroxybenzophenone of formula (2), in a mixer, into a paste with a dispersant, such as the condensate of formaldehyde with ditolyl ether sulfonate or naphthalenesulfonic acid, and water, and, after addition of any desired additional components, such as nonionic surfactants (c), further anionic and/or nonionic compounds, including the antifoam, preservative and antifreeze agent, dispersing the mixture for 1 to 30, preferably 1 to 10, hours. Dispersing is conveniently effected by the action of high shear forces, for example by milling in a ball, sand or bead mill. After milling, an aqueous solution of the stabiliser or thickener (component (d)) and, if desired, further water can be added, and the mixture is stirred until a homogeneous dispersion is obtained.

The dispersions of the invention have good stability to transportation and storage. In particular, they are very stable at high temperatures up to 130° C. when added to dyebaths.

Depending on the dye, the dispersions of the invention are used for dyeing synthetic fibres, preferably polyester fibres or also textile material which contains acid-modified polyester fibres. Each dyeing process is carried out in conventional manner. The dispersion is slowly stirred into an aqueous bath, after which the liquor is ready for dyeing after addition of the dye.

Accordingly, the invention also relates to a process for dyeing synthetic fibre material with cationic or disperse dyes. The process comprises dyeing said material in the presence of the novel dispersion of a mixture of UV absorbers.

The amounts in which the dispersions are added to the dyebaths vary from 0.5 to 10%, preferably 1 to 5%, based on the weight of the goods.

The fibre material, in particular textile material, which can be dyed in the presence of the novel aqueous dispefison comprises, for example, cellulose ester fibres, such as secondary acetate fibres and cellulose acetate fibres, aromatic polyamide fibres derived for example from poly(metaphenyleneisophthalamide), acid-modified polyester fibres, in particular linear polyester fibres. Of these, cellulose ester and polyester fibres are preferably dyed with disperse dyes and acid-modified polyester fibres and aromatic polyamide fibres preferably with cationic dyes.

By linear polyester fibres are meant in this context synthetic fibres obtained, for example, by condensation of terephthalic acid with ethylene glycol or of isophthalic acid or terephthalic acid with 1,4-bis-(hydroxymethyl)cyclohexane and copolymers of terephthalic and isophthalic acid and ethylene glycol. The linear polyester hitherto used almost exclusively in the textile industry consists of terephthalic acid and ethylene glycol. Acid-modified polyester fibres are typically polycondensates of terephthalic acid or isophthalic acid, ethylene glycol and sodium 3-(1,3- or 2,3-dihydroxypropoxy)propanesulfonate, sodium (2,3-dimethylolbutoxy)propanesulfonate, disodium isopropylidenedibenzeneoxypropylsulfonate or 3,5-dicarboxybenzenesulfonic acid, sulfonated terephthalic acid, sulfonated 4-methoxybenzenecarboxylic acid or sulfonated biphenyl-4,4'-dicarboxylic acid.

The fibre materials can also be used as blends with one another or with other fibres, for example blends of polyacrylonitrile/polyester, polyamide/polyester, polyester/cotton, polyester/viscose and polyester/wool.

The textile material to be dyed can be in different forms of presentation. Examples of suitable forms are: loose material, piecegoods such as woven or knitted fabrics, yam in cheese or muff form. The latter can have package densities of 200 to 600 g/dm$^3$, in particular 400 to 450 g/dm$^3$.

The cationic dyes suitable for the process according to the invention can belong to different classes of dyes. They are in particular the customary salts, for example chlorides, sulfates or metal halides, such as zinc chloride double salts, of cationic dyes whose cationic character derives typically from a carbonium, oxonium, sulfonium or, preferably, ammonium group. Examples of such chromophoric systems are azo dyes, preferably monoazo or hydrazone dyes, diphenylmethane, triphenylmethane, methine or azomethine dyes, coumarin, ketone-imine, cyanine, azine, xanthene, oxazine or thiazine dyes. Finally, it is also possible to use dye salts of the phthalocyanine or anthraquinone series having an external onium group, for example an alkylammonium or cycloammonium group, and also benzo-1,2-pyran dye salts which contain cycloammonium groups.

The disperse dyes to be used, which are only very sparingly soluble in water and are mostly present in the dyeing liquor in the form of a fine dispersion, can belong to a wide range of dye classes, for example the acridone, azo, anthraquinone, coumarin, methine, perinone, naphthoquinone-imine, quinophthalone, styryl or nitro dyes.

It is also possible to use mixtures of cationic or disperse dyes in the practice of this invention.

The amount of dye to be added to the liquor will depend on the desired depth of shade; suitable amounts range in general from 0.01 to 10, preferably 0.02 to 5, per cent by weight, based on the textile material used.

Depending on the textile material to be treated, the dyebaths may contain oligomer inhibitors, antifoams, crease-resist agents, retarders and, preferably, dispersants and levelling agents.

The dispersants are used in particular to ensure the fine dispersion of the disperse dyes. Suitable dispersants are those customarily used for dyeing with disperse dyes.

Suitable dispersants are preferably sulfated or phosphated polyadducts of 15 to 100 mol of ethylene oxide or preferably propylene oxide with polyhydric aliphatic alcohols of 2 to 6 carbon atoms, for example ethylene glycol, glycerol or pentaerythritol, or with amines of 2 to 9 carbon atoms having at least two amino groups or an amino group and a hydroxyl group, and also alkylsulfonates of 10 to 20 carbon atoms in the alkyl chain, alkylbenzenesulfonates having a linear or branched alkyl chain of 8 to 20 carbon atoms in the alkyl chain, for example nonylbenzenesulfonate, dodecylbenzenesulfonate, 1,3,5,7-tetramethyloctylbenzenesulfonate or octadecylbenzenesulfonate, and also alkylnaphthalenesulfonates or sulfosuccinic esters, such as sodium dioctyl sulfosuccinate.

Particularly useful anionic dispersants are ligninsulfonates, polyphosphates and, preferably, condensates of formaldehyde with aromatic sulfonic acids, condensates of formaldehyde with mono- or bi-functional phenols, for example with cresol, β-naphtholsulfonic acid and formaldehyde, with benzenesulfonic acid, formaldehyde and naphthalenesulfonic acid, with naphthalenesulfonic acid and formaldehyde or with naphthalenesulfonic acid, dihydroxydiphenyl sulfone and formaldehyde. The disodium salt of di- or tri(6-sulfo-2-naphthyl)methane is preferred.

It is also possible to use mixtures of anionic dispersants. Normally, the anionic dispersants are present in the form of their alkali metal salts, ammonium salts or amine salts. These dispersants are preferably used in an amount of 0.5 to 8 g/l of liquor.

The dyebaths can also contain customary additives, preferably electrolytes such as salts, for example sodium sulfate, ammonium sulfate, sodium phosphate or polyphosphates, ammonium phosphate or polyphosphates, metal chlorides or nitrates such as calcium chloride, magnesium chloride or calcium nitrates, ammonium acetate or sodium acetate and/or acids, for example mineral acids, such as sulfuric acid or phosphoric acid, or organic acids, preferably lower aliphatic carboxylic acids such as formic, acetic or oxalic acid. The acids are used in particular to adjust the pH of the liquors to be used according to the invention, the pH normally being from 4 to 6.5, preferably 4.5 to 6.

Dyeing is conveniently carried out from an aqueous liquor by the exhaust method. The liquor ratio can accordingly be chosen within a wide range, for example 1:3 to 1: 100, preferably 1:7 to 1:50. The temperature at which the dyeing or whitening takes place is at least 70° C. and is normally not higher than 140° C. Preferably the temperature is within the range from 80° to 135° C.

Dyeing can also be carried out in a continuous process by low application or hot application systems.

Linear polyester fibres and cellulose acetate fibres are preferably dyed by the high-temperature method in closed and advantageously also pressure-resistant machines at temperatures of above 100° C., preferably in the range from 110° to 135° C., and under atmospheric or superatmospheric pressure. Suitable closed vessels are typically circulation dyeing machines such as package or beam dyeing apparatus, winch becks, jet or drum dyeing machines, muff dyeing machines, paddle machines or jiggers.

Secondary acetate fibres are preferably dyed at temperatures of 80°–85° C. Aromatic polyamide fibres or acid-modified polyesters are preferably dyed in the temperature range from 80° to 130° C.

The dyeing process can be carried out either by treating the material to be dyed first briefly with the novel aqueous dispersion and then dyeing, or preferably by simultaneous treatment with the dispersion and the dye.

Preferably the fibre material is first run in the bath which contains the dye, the aqueous dispersion and any further additives, and which has been adjusted to pH 4.5–5.5, at 60°–80° C. for 5 minutes, the temperature is then raised to 110°–135° C., preferably 125°–130° C., over 15–35 minutes, and the dye liquor is kept at this temperature for 15 to 90 minutes, preferably 30 to 60 minutes.

The dyeings are finished by cooling the dye liquor to 60°–80° C., rinsing the dyeings with water and, if necessary, reduction clearing them in conventional manner in alkaline medium. The dyeings are then rinsed again and dried.

The dyeings obtained on synthetic fibre material, especially on linear polyester fibres, are level and tinctorially strong and, in addition, have good fastness to light and rubbing.

In the following Examples parts and percentages are by weight.

Example 1: The following components are ground in a sand mill:

17.5 parts of 2-(2'-hydroxy-3'-tert-butyl-5'-methylphenyl)-5-chlorobenzotriazole
17.5 parts of 2-hydroxy-4-octyloxybenzophenone
12.0 parts of a salt-free condensate of naphthalenesulfonic acid and formaldehyde
0.4 part of chloroacetamide, and
52.6 parts of water.

The mixture is then milled with quartz sand until the particle size is <5 μm and the resultant dispersion is subsequently separated from the quartz sand.

71.4 parts of this dispersion are homogenised by stirring with 20 parts of a 1% aqueous solution of a biopolymer based on polysaccharide and 8.6 parts of water. A storage-stable dispersion is obtained.

Example 2: The following components are mixed in a sand mill:

14.0 parts of 2-(2'-hydroxy-3'-tert-butyl-5'-methylphenyl)-5-chlorobenzotriazole 28.0 parts of 2-hydroxy-4-octyloxybenzophenone
11.2 parts of the sodium salt of a condensate of naphthalenesulfonic acid and formaldehyde
0.4 part of chloroacetamide, and
46.4 parts of water.

The mixture is then milled with quartz sand until the particle size is <5 μm and the resultant dispersion is subsequently separated from the quartz sand.

71.4 parts of this dispersion are homogenised by stirring with 15 parts of a 1% aqueous solution of a biopolymer based on polysaccharide and 13.6 parts of water. A storage-stable dispersion is obtained.

Example 3: The following components are mixed in a sand mill:

14.0 parts of 2-(2'-hydroxy-3'-tert-butyl-5'-methylphenyl)-5-chlorobenzotriazole
21.0 parts of 2-hydroxy-4-octyloxybenzophenone
11.2 parts of the sodium salt of a condensate of naphthalenesulfonic acid and formaldehyde
0.4 part of chloroacetamide, and
54.3 parts of water.

The mixture is then milled with quartz sand until the particle size is <5 μm and the resultant dispersion is subsequently separated from the quartz sand.

71.4 parts of this dispersion are homogenised by stirring with 15 parts of a 1% aqueous solution of a biopolymer based on polysaccharide and 13.6 parts of water. A storage-stable dispersion is obtained.

Example 4: The following components are ground in a sand mill:

14.0 parts of 2-(2'-hydroxy-3'-tert-butyl-5'-methylphenyl)-5-chlorobenzotriazole
28.0 parts of 2-hydroxy-4-octyloxybenzophenone
9.2 parts of a salt-free condensate of sodium ditolyl ether sulfonate and formaldehyde
0.4 part of chloroacetamide, and
48.4 parts of water.

The mixture is then milled with quartz sand until the particle size is <5 μm and the resultant dispersion is subsequently separated from the quartz sand.

71.4 parts of this dispersion are homogenised by stirring with 15 parts of a 1% aqueous solution of a biopolymer based on polysaccharide and 13.6 parts of water. A storage-stable dispersion is obtained.

Example 5: The following components are ground in a sand mill:

14.0 parts of 2-(2'-hydroxy-3'-tert-butyl-5'-methylphenyl)-5-chlorobenzotriazole
21.0 parts of 2-hydroxy-4-octyloxybenzophenone
9.2 parts of the sodium salt of a condensate of 2-naphthol-6-sulfonic acid, cresol, sodium bisulfite and formaldehyde
0.4 part of chloroacetamide, and
55.4 parts of water.

The mixture is then milled with quartz sand until the particle size is <5 μm and the resultant dispersion is subsequently separated from the quartz sand.

71.4 parts of this dispersion are homogenised by stirring with 15 parts of a 1% aqueous solution of a biopolymer based on polysaccharide and 13.6 parts of water. A storage-stable dispersion is obtained.

Example 6: The following components are ground in a sand mill:

14.0 parts of 2-(2'-hydroxy-3'-tert-butyl-5'-methylphenyl)-5-chlorobenzotriazole
21.0 parts of 2-hydroxy-4-octyloxybenzophenone
12.0 parts of the sodium salt of a condensate of 2-naphthol-6-sulfonic acid, cresol, sodium bisulfite and formaldehyde
0.4 part of chloroacetamide, and
52.6 parts of water.

The mixture is then milled with quartz sand until the particle size is <5 μm and the resultant dispersion is subsequently separated from the quartz sand.

71.4 parts of this dispersion are homogenised by stirring with 20.0 parts of a 1% aqueous solution of a biopolymer based on polysaccharide and 8.6 parts of water. A storage-stable dispersion is obtained.

Example 7: The following components are ground in a sand mill:

17.5 parts of 2-(2'-hydroxy-3 '-tert-butyl-5'-methylphenyl)-5-chlorobenzotriazole
17.5 parts of 2-hydroxy-4-dodecyloxybenzophenone
12.0 parts of the sodium salt of a condensate of ligninsulfonate, phenol and formaldehyde
1.0 part of a polyadduct of 9 mol of ethylene oxide with 1 mol of nonylphenol
1.0 part of a polyadduct of ethylene oxide with the adduct of propylene oxide and propylene glycol, the polypropylene oxide component having an average molecular weight of c. 2050 and containing c. 50% of polyethylene oxide in the molecule,
0.4 part of chloroacetamide, and
50.6 parts of water.

The mixture is then milled with quartz sand until the particle size is <5 μm and the resultant dispersion is subsequently separated from the quartz sand.

71.4 parts of this dispersion are homogenised by stirring with 20.0 parts of a 1% aqueous solution of a biopolymer based on polysaccharide and 8.6 parts of water. A storage-stable dispersion is obtained.

Example 8: The following components are ground in a sand mill:

14.0 parts of 2-(2'-hydroxy-3'-tert-butyl-5'-methylphenyl)-5-chlorobenzotriazole
21.0 parts of 2-hydroxy-4-dodecyloxybenzophenone
12.0 parts of the reaction product, neutralised with triethanolamine, of phosphorus pentoxide with the polyadduct (18 EO units) of ethylene oxide with 2.5 to 3 mol of styrene and 1 mol of phenol,
0.4 part of chloroacetamide, and
50.6 parts of water.

The mixture is then milled with quartz sand until the particle size is <5 μm and the resultant dispersion is subsequently separated from the quartz sand.

71.4 parts of this dispersion are homogenised by stirring with 20.0 parts of a 1% aqueous solution of a biopolymer based on polysaccharide and 8.6 parts of water. A storage-stable dispersion is obtained.

Example 9: The following components are ground in a sand mill:

17.5 parts of 2-(2'-hydroxy-3'-tert-butyl-5'-methylphenyl)-5-chlorobenzotriazole
17.5 parts of 2-hydroxy-4-dodecyloxybenzophenone 12.0 parts of a polyadduct of ethylene oxide with the adduct of propylene oxide and propylene glycol, the polypropylene oxide component having an average molecular weight of c. 3250 and containing c. 20% of polyethylene oxide in the molecule,
0.4 part of chloroacetamide, and
52.6 parts of water.

The mixture is then milled with quartz sand until the particle size is <5 μm and the resultant dispersion is subsequently separated from the quartz sand.

71.4 parts of this dispersion are homogenised by stirring with 20.0 parts of a 1% aqueous solution of a biopolymer based on polysaccharide and 8.6 parts of water. A storage-stable dispersion is obtained.

Example 10: The following components are ground in a sand mill:

14.0 parts of 2-(2'-hydroxy-3'-tert-butyl-5'-methylphenyl)-5-chlorobenzotriazole
24.5 parts of 2,4-dihydroxybenzophenone
9.2 parts of a polyadduct of ethylene oxide with the adduct of propylene oxide and propylene glycol, the polypropylene oxide component having an average molecular weight of c. 3250 and containing c. 20% of polyethylene oxide in the molecule,
0.4 part of chloroacetamide, and
51.9 parts of water.

The mixture is then milled with quartz sand until the particle size is <5 μm and the resultant dispersion is subsequently separated from the quartz sand.

71.4 parts of this dispersion are homogenised by stirring with 12.5 parts of a 2% aqueous solution of a biopolymer based on polysaccharide and 16.1 parts of water. A storage-stable dispersion is obtained.

Example 11: The following components are ground in a sand mill:

14.0 parts of 2-(2'-hydroxy-3'-tert-butyl-5'-methylphenyl)-5-chlorobenzotriazole
24.5 parts of 2,4-dihydroxybenzophenone
11.3 parts of sodium salt of a condensate of naphthalinesulfonic acid and formaldehyde
0.4 part of chloroacetamide, and
49.8 parts of water.

The mixture is then milled with quartz sand until the particle size is <5 μm and the resultant dispersion is subsequently separated from the quartz sand.

71.4 parts of this dispersion are homogenised by stirring with 20.0 parts of a 2% aqueous solution of a biopolymer based on polysaccharide and 16.1 parts of water. A storage-stable dispersion is obtained.

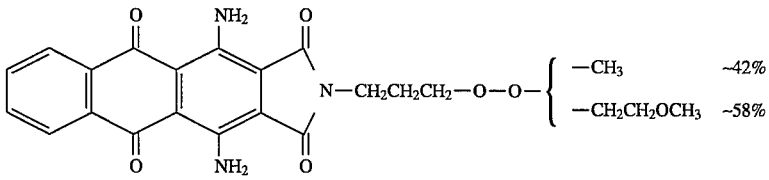

(104)

Example 12: The following components are ground in a sand mill:

14.0 parts of 2-(2'-hydroxy-3'-tert-butyl-5'-methylphenyl)-5-chlorobenzotriazole
24.5 parts of 2,4-dihydroxybenzophenone
12.0 parts of the reaction product, neutralised with triethanolamine, of phosphorus pentoxide with the polyadduct (18 EO units) of ethylene oxide with 2.5 to 3 mol of styrene and 1 mol of phenol,
0.4 part of chloroacetamide, and
49.1 parts of water.

The mixture is then milled with quartz sand until the particle size is <5 μm and the resultant dispersion is subsequently separated from the quartz sand.

71.4 parts of this dispersion are homogenised by stirring with 12.5 parts of a 2% aqueous solution of a biopolymer based on polysaccharide and 8.6 parts of water. A storage-stable dispersion is obtained.

Application Examples:

100 g of a polyester knitted fabric (polyethylene glycol terephthalate) are put at 60° C. into a HT circulation dyeing machine, at a liquor ratio of 1:10, containing 1 liter of
2 g of ammonium sulfate,
a mixture of dyes comprising
0.37% of the dye of formula

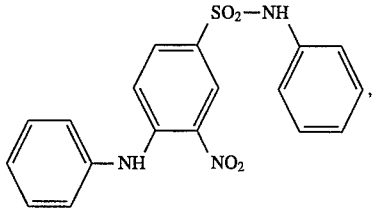

(101)

0.067% of the dye of formula

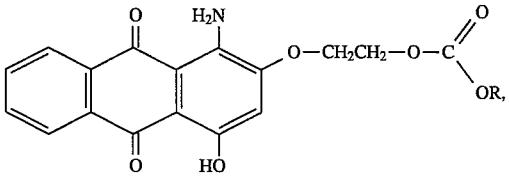

(102)

0.01% of the dye of formula

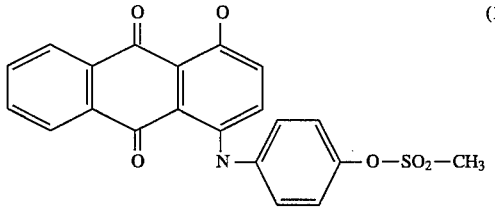

(103)

0.013% of the dye of formula (the percentages of the dyes are based on the weight of the goods)

and a 25% aqueous formulation of a UV absorber mixture.

The pH of the dyebath is adjusted to 5 with 85% formic acid. With constant circulation of the liquor, the dyebath is heated over 30 minutes to 130° C. and dyeing is carried out for 1 hour at this temperature. The dyebath is then cooled and the substrate is rinsed and reduction cleared in conventional manner for 20 minutes at 70° C. to remove unfixed dye with 5 ml/l of sodium hydroxide (36 Bè) and 2 g/l of conc. hydrosulfite.

Thereafter the substrate is neutralised, rinsed once more and dried.

The dyeings produced in accordance with this recipe formulation (Examples 13–25) are tested for their lightfastness properties according to DIN 75.202 (FAKRA), SAE 420 kJ and JASO 400 h with the combination formulations of UV absorbers prepared in Examples 2–5 in varying concentrations.

The results are reported in Table 1:

TABLE 1

| | UV absorber formulation of Example | UV absorber formulation [%] | Lightfastness test FAKRA 3X | SAE 420 kJ | JASO 400 h |
|---|---|---|---|---|---|
| Example 13 | —*1) | — | 3.0 | 2.0 | 2.5 |
| Example 14 | *2) | 1 | 3.5 | 2.5 | 3.0 |
| Example 15 | *2) | 2 | 3.5 | 2.5 | 3.5 |
| Example 16 | *2) | 3 | 3.5 | 2.5 | 3.5 |
| Example 17 | 2 (30%) | 0.8 | 4.0 | 2.5 | 3.5 |
| Example 18 | 2 (30%) | 1.6 | 4.0 | 3.0 | 3.5 |
| Example 19 | 2 (30%) | 2.5 | 4.0 | 3.0 | 4.0 |
| Example 20 | 3 (25%) | 1 | 4.0 | 2.5 | 3.5 |
| Example 21 | 3 (25%) | 2 | 4.0 | 3.0 | 4.0 |
| Example 22 | 3 (25%) | 3 | 4.0 | 3.0 | 4.0 |
| Example 23 | 4 (30%) | 0.8 | 4.0 | 2.5 | 4.0 |
| Example 24 | 4 (30%) | 1.6 | 4.0 | 3.0 | 4.0 |
| Example 25 | 4 (30%) | 2.5 | 4.0 | 3.0 | 4.0 |

*1)without UV absorber

*2)commercial UV absorber formulation based on 2-(2'-hydroxy-3-'tert-butyl-5-'methylphenyl)-5-chlorobenzotriazole (25%)

The results show that, compared with dyeings obtained without UV absorber (Example 13) and using a commercial UV absorber formulation based on 2-(2'-hydroxy-3'-tert-butyl-5'-methylphenyl)-5-chlorobenzotriazole (Example 14), dyeings which are produced using the novel aqueous dispersions of UV absorber mixtures have markedly better lightfastness properties.

What is claimed is:

1. An aqueous dispersion of a mixture of sparingly soluble UV absorbers, which comprises (a) 5 to 50% by weight of a mixture of a benzotriazole of formula

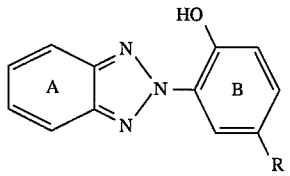

(1)

and a 2-hydroxybenzophenone of formula

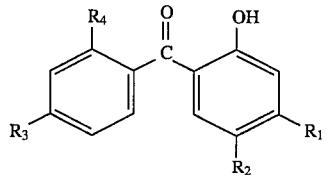

(2)

wherein R is halogen, $C_1$-$C_{12}$alkyl, lower alkoxy, lower alkoxycarbonyl, cycloalkyl, aryl, $C_1$-$C_{12}$alkylaryl or aralkyl, and the rings A and B, each independently of the other, may be further substituted by halogen, hydroxy, lower alkyl, lower alkoxy or lower alkoxycarbonyl, $R_1$ is hydrogen, hydroxy, $C_1$-$C_{14}$alkoxy or phenoxy, $R_2$ is hydrogen, halogen or lower alkyl, $R_3$ is hydrogen, hydroxy or lower alkoxy, and $R_4$ is hydrogen or hydroxy, (b) 2 to 18% by weight of an anionic compound, and (c) 0 to 10% by weight of a nonionic compound.

2. A dispersion according to claim 1, which contains the compounds of formulae (1) and (2) in a weight ratio (1):(2) of 30:1 to 1:30.

3. A dispersion according to claim 1, which contains the compounds of formulae (1) and (2) in a weight ratio (1):(2) of 5:1 to 1:5, wherein the weight ratio of the compound of formula in the dispersion (1) is smaller than 20%.

4. A dispersion according to claim 1, wherein the ring A in formula (1) is substituted in 5-position by halogen, lower alkyl or lower alkoxy.

5. A dispersion according to claim 1, wherein the benzene ring B in formula (1) is further substituted in vicinal position to the hydroxyl group by lower alkyl or halogen.

6. A dispersion according to claim 5, wherein the benzotriazole of component (a) has the formula

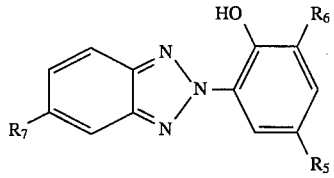

(3)

wherein $R_5$ is halogen, lower alkyl or lower alkoxy, and $R_6$ and $R_7$ are each independently of the other hydrogen, halogen, lower alkyl or lower alkoxy.

7. A dispersion according to claim 6, wherein $R_5$ is lower alkyl, $R_6$ is hydrogen or lower alkyl and $R_7$ is hydrogen, chloro or methyl.

8. A dispersion according to claim 1, wherein $R_1$ is hydroxy or $C_1$–$C_{14}$alkoxy in formula (2).

9. A dispersion according to claim 1, wherein component (b) is a compound selected from the group consisting of (ba) acid esters, or their salts, of alkylene oxide polyadducts of formula

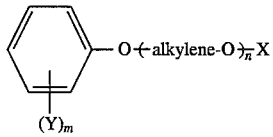

(4)

wherein X is the acid radical of an inorganic oxygen-containing acid or is the radical of an organic acid, and Y is $C_1$-$C_{12}$alkyl, aryl or aralkyl, "alkylene" is the ethylene or propylene radical, and m is 1 to 4 and n is 4 to 50, (bb) polystyrene sulfonates, (bc) fatty acid taurides, (bd) alkylated diphenyl oxide mono- or disulfonates, (be) sulfonates of polycarboxylates, (bf) polyadducts of 1 to 60 mol of ethylene oxide and/or propylene oxide with fatty amines, fatty amides, fatty acids or fatty alcohols, each of 8 to 22 carbon atoms or with trihydric to hexahydric alkanols of 3 to 6 carbon atoms, which polyadducts have been convened into an acid ester with an organic dicarboxylic acid or an organic polybasic acid, (bg) ligninsulfonates, and (bh) formaldehyde condensates.

10. A dispersion of claim 9 wherein component (b) is a compound selected from the group consisting of an acid ester of formula 4 wherein X is a sulfuric or phosphoric acid radical and polyadducts of 2 to 30 mol of ethylene oxide and/or propylene oxide with fatty amines, fatty amides, fatty acids or fatty alcohols, each of 8 to 22 carbon atoms or with trihydric to hexahydric alkanols of 3 to 6 carbon atoms, which polyadducts have been converted into an acid ester with an organic dicarboxylic acid or an organic polybasic acid.

11. A dispersion according to claim 9, wherein component (b) is a compound of formula (4), or the salt thereof, wherein X is the radical of phosphoric acid, n is 6 to 30, "alkylene" is the ethylene radical, m is 1 to 4 and Y is $C_1$-$C_{12}$alkyl, benzyl, α-methylbenzyl, α,α-dimethylbenzyl, β-phenethyl, α-tolylethyl or phenisopropyl.

12. A dispersion according to claim 9, wherein component (b) is a condensate of formaldehyde and an aromatic sulfonic acid.

13. A dispersion according to claim 12, wherein component (b) is a condensate of formaldehyde and naphthalenesulfonic acid.

14. A dispersion according to claim 12, wherein component (b) is a condensate of formaldehyde and ditolyl ether sulfonate.

15. A dispersion according to claim 1, wherein optional component (c) is a nonionic compound selected from the group consisting of (ca) alkylene oxide polyadducts of formula

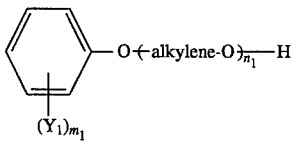

(10)

wherein $Y_1$ is $C_1$-$C_{12}$alkyl, aryl or aralkyl,

"alkylene" denotes an ethylene radical or a propylene radical and $m_1$ is 1 to 4 and $n_1$ is 4 to 50, (cb) polyadducts of alkylene oxide with saturated or unsaturated monohydric to hexahydric aliphatic alcohols, fatty acids, fatty mines, fatty amides, diamines, sorbitan esters;

(cc) block polymers of alkylene oxide condensates, (cd) polymers of vinyl pyrrolidone, vinyl acetate or vinyl alcohol, and (ce) copolymers or terpolymers of vinyl pyrrolidone with vinyl acetate and/or vinyl alcohol.

16. A dispersion according to claim 15, wherein component (c) is a compound of formula (10), wherein $n_1$ is 6 to 30, "alkylene" is the ethylene radical and $Y_1$ is 4-nonyl and $m_1$ is the number 1, or $Y_1$ is nonyl and $m_1$ is the number 2, or $Y_1$ is α-methylbenzyl and $m_1$ is the number 1, 2 or 3.

17. A dispersion according to claim 1, which additionally comprises a stabiliser or thickener as component (d).

18. A dispersion according to claim 16, wherein component (d) is a polysaccharide.

19. A dispersion according to claim 1, which additionally comprises a preservative and/or an antifreeze agent.

20. A dispersion according to claim 1, wherein component (a) is a mixture of a UV absorbing benzotriazole and a 2-hydroxybenzophenone of formulae (1) and (2), and component (b) is a condensate of formaldehyde and an aromatic sulfonic acid.

21. A dispersion according to claim 20, wherein component (a) is a mixture of a UV absorbing benzotriazole of formula

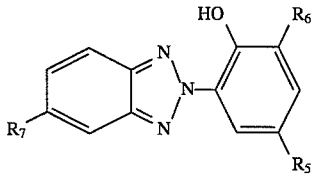

(3)

wherein $R_5$ is lower alkyl, $R_6$ is hydrogen or lower alkyl, and $R_7$ is hydrogen, chloro or methyl, and a 2-hydroxybenzophenone of formula (2), wherein $R_1$ is $C_1$-$C_{14}$alkoxy, and component (b) is a condensate of formaldehyde with an aromatic sulfonic acid.

22. A dispersion according to claim 17, which comprises, in each case based on the entire dispersion, 5–50 percent by weight of component (a), 20–18 percent by weight of component (b), 0–10 percent by weight of component (c), 0–5 percent by weight of component (d), 0–8 percent by weight of further anionic components other than component (b), 0–8 percent by weight of further nonionic components other than component (c), 0–1 percent by weight of antifoam, 0–1 percent by weight of preservative, and 0–20 percent by weight of antifreeze agent.

23. A process for dyeing synthetic fibres with disperse or cationic dyes, which comprises dyeing said material in the presence of an aqueous dispersion of a mixture of a benzotriazole and a 2-hydroxybenzophenone as claimed in claim 1.

24. A process of claim 23 wherein the synthetic fibre is a textile material containing polyester fibers or acid-modified polyester fibers.

25. The fibre material dyed by a process as claimed in claim 23.

* * * * *